US009238859B2

(12) United States Patent
Barjon et al.

(10) Patent No.: US 9,238,859 B2
(45) Date of Patent: Jan. 19, 2016

(54) METHOD FOR THE HARDENED GALVANIZATION OF A STEEL STRIP

(75) Inventors: Stephane Barjon, Cournon d'Auvergne (FR); Arnaud D'Halluin, Villeurbane (FR); Benjamin Grenier, Saint-Paul-en-Jarez (FR)

(73) Assignee: Primetals Technologies France SAS, Savigneux (FR)

( * ) Notice: Subject to any disclaimer, the term of this patent is extended or adjusted under 35 U.S.C. 154(b) by 229 days.

(21) Appl. No.: 12/866,791

(22) PCT Filed: Feb. 8, 2008

(86) PCT No.: PCT/FR2008/000163

§ 371 (c)(1),
(2), (4) Date: Aug. 9, 2010

(87) PCT Pub. No.: WO2009/098362

PCT Pub. Date: Aug. 13, 2009

(65) Prior Publication Data

US 2010/0323095 A1 Dec. 23, 2010

(51) Int. Cl.

| | |
|---|---|
| ***C23C 2/00*** | (2006.01) |
| ***C23C 2/06*** | (2006.01) |
| ***C23C 2/40*** | (2006.01) |

(52) U.S. Cl.

CPC . *C23C 2/003* (2013.01); *C23C 2/06* (2013.01); *C23C 2/40* (2013.01)

(58) Field of Classification Search

CPC ..... C23C 2/003
USPC ..... 427/435–436, 8
See application file for complete search history.

(56) References Cited

U.S. PATENT DOCUMENTS 2,235,720 A * 3/1941 Matarese ..... 182/222
3,808,033 A * 4/1974 Mayhew ..... 427/349

(Continued)

FOREIGN PATENT DOCUMENTS

CN 1202538 A 12/1998
CN 101092668 A 12/2007

(Continued)

OTHER PUBLICATIONS

Belisle et al. The Solubility of Iron in Continuous Hot-Dip Galvanizing Baths. Journal of Phase Equilibria, vol. 12 No. 3. 1991. pp. 259-265.*

(Continued)

*Primary Examiner* — David Turocy
(74) *Attorney, Agent, or Firm* — Laurence A. Greenberg; Werner H. Stemer; Ralph E. Locher

(57) ABSTRACT

A method produces a hardened galvanization of a continuously-running rolled steel strip. The strip is immersed in a coating tank containing a bath of a liquid metal mixture, e.g. zinc and aluminum, to be deposited on the strip, and permanently circulated between the coating tank and a preparation device. The temperature of the liquid mixture is deliberately lowered in order to reduce the iron solubility threshold and sufficiently high for initiating, in the preparation device, the fusion of at least one Zn—Al ingot in an amount necessary for compensating for the liquid mixture used for deposition on the strip. The device is implemented so that the circuit for circulating the liquid mixture is thermally optimized.

28 Claims, 10 Drawing Sheets

(56) References Cited

U.S. PATENT DOCUMENTS

| | | | | | |
|---|---|---|---|---|---|
| 5,084,094 | A | * | 1/1992 | Francois et al. | 75/663 |
| 5,558,715 | A | * | 9/1996 | Abed et al. | 118/429 |
| 5,598,329 | A | * | 1/1997 | Niemann | 700/30 |
| 5,958,518 | A | | 9/1999 | Sippola | |
| 5,965,210 | A | | 10/1999 | Tada et al. | |
| 6,426,122 | B1 | * | 7/2002 | Ishii et al. | 427/433 |
| 2002/0076502 | A1 | | 6/2002 | Ishii et al. | |
| 2011/0195181 | A1 | | 8/2011 | Jin et al. | |

FOREIGN PATENT DOCUMENTS

| | | | | |
|---|---|---|---|---|
| EP | 0429351 | A1 | | 5/1991 |
| EP | 1070765 | A1 | | 1/2001 |
| JP | 57035671 | A | | 2/1982 |
| JP | 3188250 | A | | 8/1991 |
| JP | 5171386 | A | | 7/1993 |
| JP | 05186857 | A | * | 7/1993 |
| JP | 5222500 | A | | 8/1993 |
| JP | 5271893 | A | | 10/1993 |
| JP | 8053744 | A | | 2/1996 |
| JP | 2808334 | B2 | | 10/1998 |
| JP | 11050217 | A | | 2/1999 |
| JP | 11323519 | A | | 11/1999 |
| JP | 2001262306 | A | * | 9/2001 |
| JP | 2004339553 | A | | 12/2004 |
| JP | 2005029890 | A | | 2/2005 |
| JP | 2005248208 | A | * | 9/2005 |
| JP | 2005248330 | A | | 9/2005 |
| JP | 2005256060 | A | | 9/2005 |
| JP | 2008095207 | A | | 4/2008 |
| JP | 4503086 | B2 | | 7/2010 |
| KR | 2004006739 | A | * | 1/2004 |
| RU | 2209846 | C2 | | 8/2003 |
| WO | 9951789 | A1 | | 10/1999 |

OTHER PUBLICATIONS

Machine Translation of JP 2001262306 A.*

Machine Translation of JP 05186857 A.*

Ajersch et al, "Simulation of Flow in a Continuous Galvanizing Bath: Part II. Transient Aluminum Distribution Resulting from Ingot Addition", Metalurgical and Materials Transactions, Physical Metallurgy & Materials Science ASM International, Materials Park, OH, US, vol. 35B, No. 1, Feb. 2004, pp. 171-178, XP001195345.

Ilinca et al, "Numerical Simulation of the Galvanizing Process during GA to GI Transition", International Journal of Numerical Methods in Fluids, vol. 53, No. 10, Apr. 2007, pp. 1629-1646, XP002501709.

* cited by examiner

METHOD FOR THE HARDENED GALVANIZATION OF A STEEL STRIP

BACKGROUND OF THE INVENTION

Field of the Invention

The present invention relates to a method for the hardened galvanization of a steel strip according to the pre-characterizing clause of claim 1.

The hardened galvanization of continuously-running rolled steel strips is a known technique which essentially comprises two variants, that where the strip exiting a galvanizing furnace lowers obliquely into a bath of liquid metal comprising at least one metal suited to galvanization such as zinc or aluminum and is located deflected vertically and upwards by a roller immersed in said bath of liquid metal. The other variant consists of deflecting the strip vertically and upwards as the latter exits the furnace and then causing it to run through a vertical channel containing liquid zinc sustained magnetically. The bath of liquid metal is a zinc alloy with variable proportions of aluminum, magnesium or manganese. For the clarity of the patent, only the case of a zinc or aluminum alloy will be described.

In both cases, the aim of the operation is to create on the surface of the steel strip a continuous and adhesive deposit of a liquid mixture of zinc and aluminum in which said strip runs through. The formation kinetics of this deposit is known by a person skilled in the art; it has formed the subject of numerous communications among which "Modeling of galvanizing reactions" by Giorgi et Al, in "La Revue de Métallurgie—CIT" [Metallurgy Review—CIT] dated October 2004. This documentation establishes that contact with the liquid mixture causes the dissolution of iron from the steel strip which partly participates in the formation of a compound layer of approximately 0.1μ of compound $Fe_2Al_5Zn_x$ on the surface of the strip and, partly, diffuses towards the bath of liquid mixture when the layer of $Fe_2Al_5Zn_x$ is not formed continuously. The layer of $Fe_2Al_5Zn_x$ acts as a support to the final protective layer of zinc while the dissolved iron contributes to the formation in the liquid mixture of precipitates composed of iron Fe, aluminum Al and zinc Zn called "matte" or "dross". These precipitates in the form of particles from a few microns to several tens of microns in size are able to cause appearance faults on the coated (galvanized) strip which may be redhibitory, in particular when these strips of sheet metal are intended to form the visible parts of automobile bodies. Considerable effort is therefore made by steel workers in order to limit or eliminate the dross of the galvanizing baths. The phenomenon of dross formation is known by a person skilled in the art through, for example, communications such as "Numerical simulation of the rate of dross formation in continuous galvanizing baths" by Ajersch et al. Depending on the temperature of a bath of liquid zinc and its aluminum content, the amount of iron capable of being dissolved varies within quite considerable limits. When an iron content exceeds the solubility limit, nucleation and growth of defined Fe—Al—Zn compounds becomes possible. In the normal methods of continuous galvanization, a coating bath containing the liquid mixture to be deposited on the strip is always saturated with iron, it follows that all of the iron dissolved from the strip and diffusing into the liquid mixture is immediately available for the creation of dross in situ.

Among the means envisaged to try to control the dross or, at least, to reduce its quantity in the coating tank, manual skimming of the surface of the liquid mixture has been performed for a long time. As this method was justly considered to be dangerous for the operators, it was envisaged to mechanize then robotize this skimming operation as described in JP 2001-064760.

Other diverse techniques from overflowing, pumping or ejection have been envisaged in order to discharge the dross formed in the coating tank. Thus, EP 1 070 765 describes a series of variants of a galvanizing installation comprising, in addition to a coating tank in which dross is formed, an auxiliary tank towards which the dross is discharged.

In a more elaborate manner, EP 0 429 351 describes a method and a device which aims to circulate a liquid mixture between a coating zone of the metal strip and a purification zone of the galvanizing bath containing liquid zinc, to ensure the separation of dross in the purification zone then to transport a liquid mixture "whose iron content is close to or less than the solubility limit" towards the coating zone. But, whilst the physical principles involved are correctly described, this document gives no information to enable the person skilled in the art to implement them, in particular how to simultaneously control cooling by a heat exchanger and reheating by induction of the same purification zone. No information is given on how to determine a circulating rate of liquid zinc.

BRIEF SUMMARY OF THE INVENTION

One aim of the present invention is to provide a method for the hardened galvanization of a steel strip in a liquid mixture, in which a circuit for circulating the liquid mixture is thermally optimized.

The method for a hardened galvanization of a continuously-running rolled steel strip, includes the step of immersing the steel strip in a coating tank containing a bath of a liquid metal mixture to be deposited on the steel strip and permanently circulated between the coating tank and a preparation device, in which a temperature of the liquid metal mixture is deliberately lowered in order to reduce an iron solubility threshold and sufficiently high for initiating, in the preparation device, fusion of at least one Zn-Al ingot in an amount necessary for compensating for the liquid metal mixture used for deposition on the steel strip. A first power supplied by the steel strip entering at a first temperature in the bath of the liquid metal mixture of the coating tank is determined. The bath itself is stabilized at a second predetermined temperature being lower than the first temperature. A second power necessary to raise the liquid metal mixture to the second predetermined temperature is determined and the second power is compared to the first power supplied by the metal strip. A reduction setpoint is assigned to the first temperature of the metal strip if the first power is greater than the second power. The energy required for continuous fusion, in the preparation device, of the ingot in an amount necessary for compensating for the liquid metal mixture used for deposition on the metal strip is determined if the first power is less than or equal to the second power. A circulating rate is set for the liquid metal mixture between entering the coating tank and the preparation device to provide the necessary energy for the continuous fusion of the ingot while maintaining the temperature of the liquid metal mixture in the preparation device at a third predetermined temperature being lower than the second predetermined temperature. A fourth temperature of the liquid metal mixture is set at an outlet of the preparation device in order to provide additional power necessary for a thermal equilibrium between the outlet and a supply inlet of the coating tank, the supply inlet being supplied by the outlet.

In order to be able to illustrate more clearly the aspects of the method proposed according to the invention, an installation for the hardened galvanization of a steel strip in a liquid mixture and one of its variants enabling the implementation of the method are presented using FIGS. 1 and 2:

DESCRIPTION OF THE INVENTION

Figure 1:
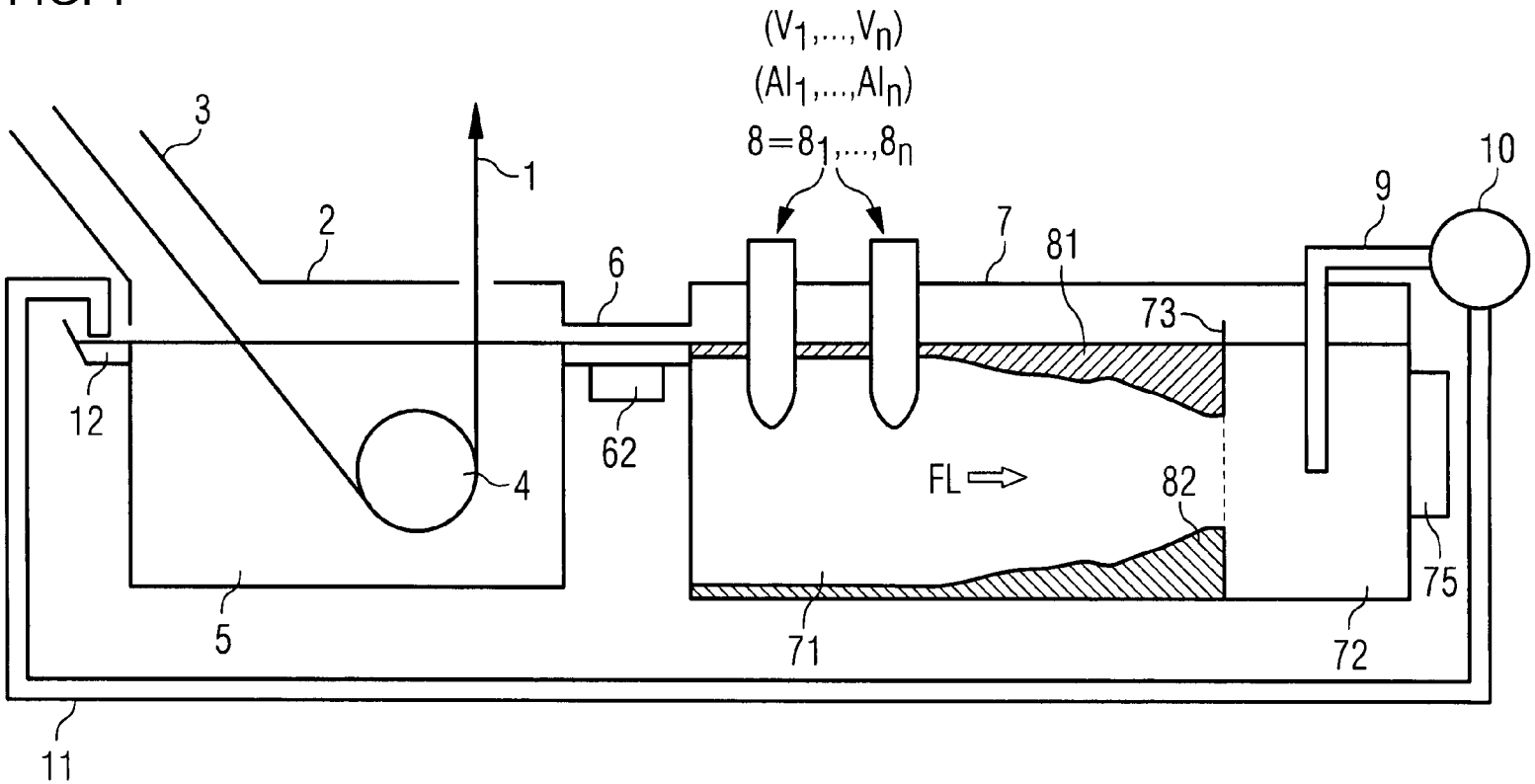
FIG. 1 shows a schematic diagram of an installation implementing the method.

FIG. 1 shows a schematic diagram of the installation for the implementation of the method according to the invention. A steel strip (1) is introduced into the installation, ideally continuously running, obliquely in a coating tank (2) through the connector line to a galvanizing furnace (3) (not represented upstream of the coating tank). The strip is deflected vertically by a roller (4) and traverses a liquid coating mixture (5) contained in said coating tank. The deflection of the strip may be achieved by means of a horizontal roller (4) accompanying the running of the strip. A channel (6) enables the flow of excess liquid mixture towards a preparation device (7) composed of two zones; a first zone (71) in which is ensured the fusion of at least one alloy ingot Zn—Al (8) in the necessary quantity to compensate for the liquid mixture used for deposition on the strip in the coating tank and during inevitable losses (material), and a second zone (72) sequentially juxtaposed to the first zone and according to a flow path direction of liquid mixture (coating tank towards the first zone then the second zone). These two zones may be located in the same tank as indicated on FIG. 1 and therefore separated by a separating device (73), such as a wall with a central opening or may be comprised of two separate tanks placed side by side. Between these two separate tanks and placed side by side, the liquid mixture may also be transferred by pumping or by a connecting channel. The level of a pumping input in the first zone (71) or the level of the connecting channel input are favorably located between the upper decanting zone of surface dross (81) and the lower sedimentation zone of bottom dross (82) which is in the middle third of the top of the zone (71). Specifically, at this middle height of the preparation device, the method according to the invention provides that it is possible to isolate a dross-free opening between the two lower and upper accumulation zones (gradually increasing according to the flow direction (FL)) of said dross (81, 82).

The liquid mixture from the coating tank is at a sufficiently high temperature for ingot fusion. The consumption of energy for ingot fusion leads to cooling of the liquid mixture which causes the formation of dross on the surface (81) and bottom (82) retained by the downstream sealed parts by the separation device (73). An additional cooling means (62) for the purposes of cooling the ingots by consumption may be also be disposed between the coating tank and the preparation device, for example on their connecting channel (6). The second zone (72) of the preparation device therefore receives a purified liquid mixture which may be heated by a heating means (75), preferably by induction. A tube (9) recovers the liquid mixture in the second zone (72) and, in the case of FIG. 1, under the action of a pumping device (10) and a tube like a reflux path (11) resupplies the coating tank (2) by means of a trough (12) according to a flow of purified liquid mixture. Devices such as, for example, skimming or pumping systems enable dross to be discharged out of the preparation device (first zone (71)). Advantageously, the first zone (71) of the preparation device may comprise partitions isolating portions of liquid mixture disposed between several ingots (8), sequentially disposed in the direction of the flow path. These partitions may be created by means of a wall open in its middle section, thus enabling the dross to concentrate on the bottom (82) and surface (81), ingot by ingot, according to their aluminum content.

With regard to ingot fusion, the first zone (71) of the preparation device advantageously comprises several ingots ($\mathbf{8}_1$, $\mathbf{8}_2$, . . . , $\mathbf{8}_n$) of which at least two comprise a different aluminum content and of which at least one of the ingots has a greater content to the content required of the liquid mixture in the preparation device. Furthermore, the first zone (71) of the preparation device comprises a means for regulating the fusion rate of at least two ingots, ideally by selective dipping or removal of at least one ingot in the first zone (71). Finally, the first compartment of the preparation device may comprise a means for regulating (6, 62) a lower predefined temperature (T2, T3) of the liquid mixture in which the ingots melt, ideally also achieved initially by selective dipping or removal of at least one ingot in the first zone (71).

With this in mind, the continuous fusion of ingots (8) in the preparation device (71) is ensured at a total fusion rate of at least two ingots. It is thus advantageous that a plurality of n ingots dipped simultaneously in the bath of liquid mixture each have a different aluminum content and at least one of them has a greater aluminum content than that required in the preparation device in order to be able to establish a variable content profile (or fusion rate) according to time. This required content can be determined from an aluminum consumption measured or estimated in the coating tank, in the compound $Fe_2Al_5Zn_x$ layer formed on the surface of the strip and in the dross formed in the preparation device. Advantageously, the fusion rate of each of the n ingots can also be controlled individually in order to adjust the aluminum content required whilst maintaining the total fusion speed required.

Continuous fusion of the ingots in the preparation device causes local cooling of the liquid mixture from the second temperature (coating tank outlet) to a predetermined temperature in the first zone (71) with a view to lowering the iron solubility threshold and to enable the localized formation of dross in said preparation device up to the solubility threshold at the predetermined temperature. The so-called "surface"

dross, with a high aluminum content, thus preferentially forms in close proximity to the immersed ingots with a high aluminum content then settles near the surface and the so-called "bottom" dross, with a high zinc content, preferentially forms in close proximity to the immersed ingots with a low aluminum content then sediments near the bottom.

After dross formation, the replenishment flow of the liquid mixture entering the coating tank with an iron content equal to the iron solubility threshold at the predetermined temperature allows the increase in dissolved iron content to be limited to below the solubility threshold at the second temperature.

The preparation device (7) may thus be composed of a single tank comprising two zones (71, 72) separated by a separating device (73), the first zone ensuring the fusion of ingots and localizing dross formation, the second zone receiving the purified liquid mixture. In this case, the second zone is equipped with a simple and unique heating means (75) by induction ensuring the heating of the purified liquid mixture prior to it returning to the coating tank, in order to ensure a thermal reflux path loop at the end of the flow path until the new flow starts again. The two zones (71) and (72) may also be in two separate tanks connected by a connecting channel.

Figure 2:
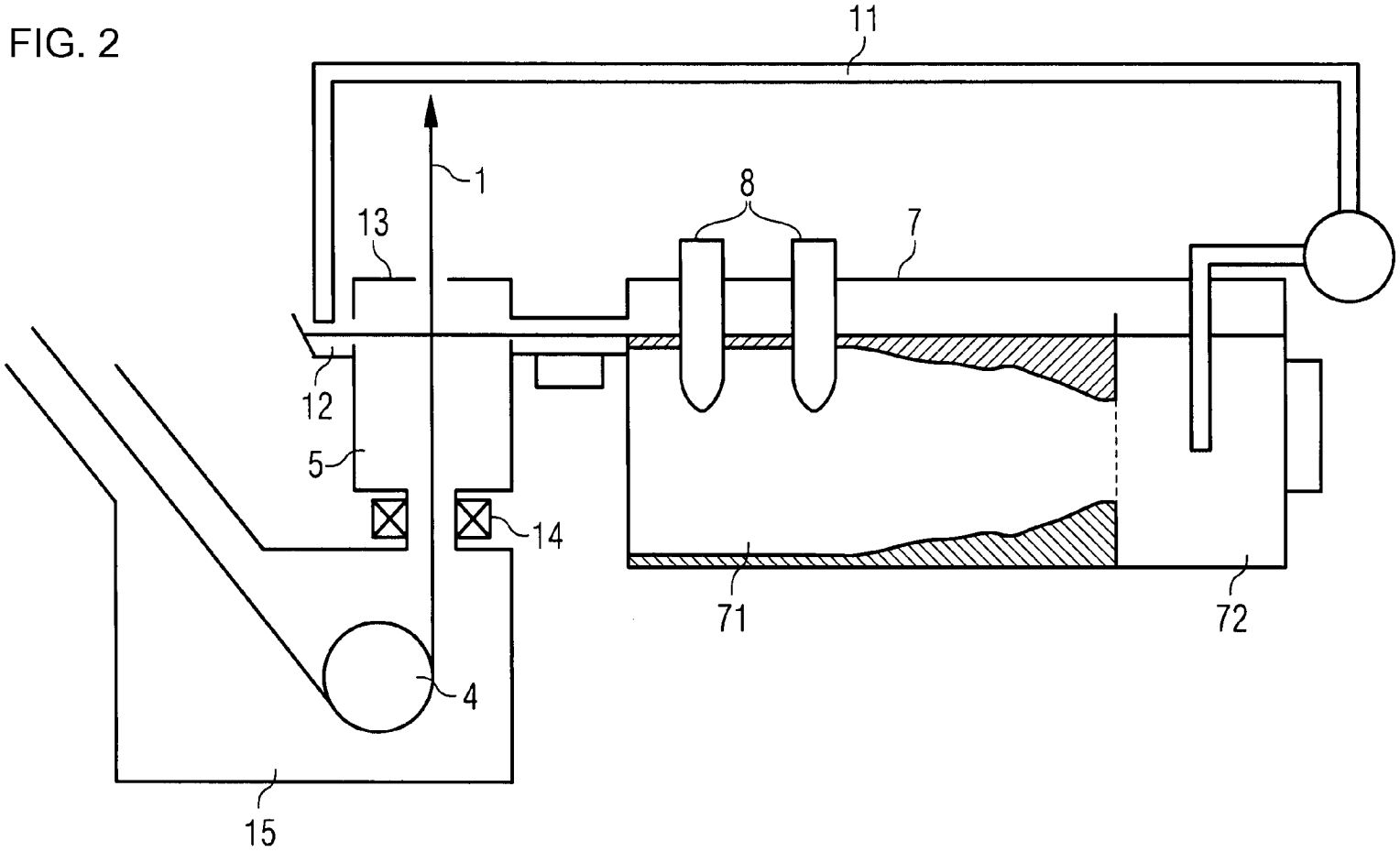
FIG. 2 shows a schematic diagram of a variant of the installation implementing the method.

FIG. 2 presents a variant of the schematic diagram of the installation according to FIG. 1 in which the initial coating tank is sub-divided into a first deflection tank (15) of the strip (without liquid mixture) and a coating tank (13) comprising a bath of liquid mixture (5) maintained by magnetic levitation. Principally, the present installation thus implements a variant of the method in which the bath of liquid mixture (5) is maintained by magnetic levitation in a coating tank (13) connected to the preparation device such as in FIG. 1. The levitation effect is ensured continuously by electromagnetic devices (14). A compartment (15) ensures the connection to the furnace and the deflection of the strip (1) by the roller (4).

Figure 3:
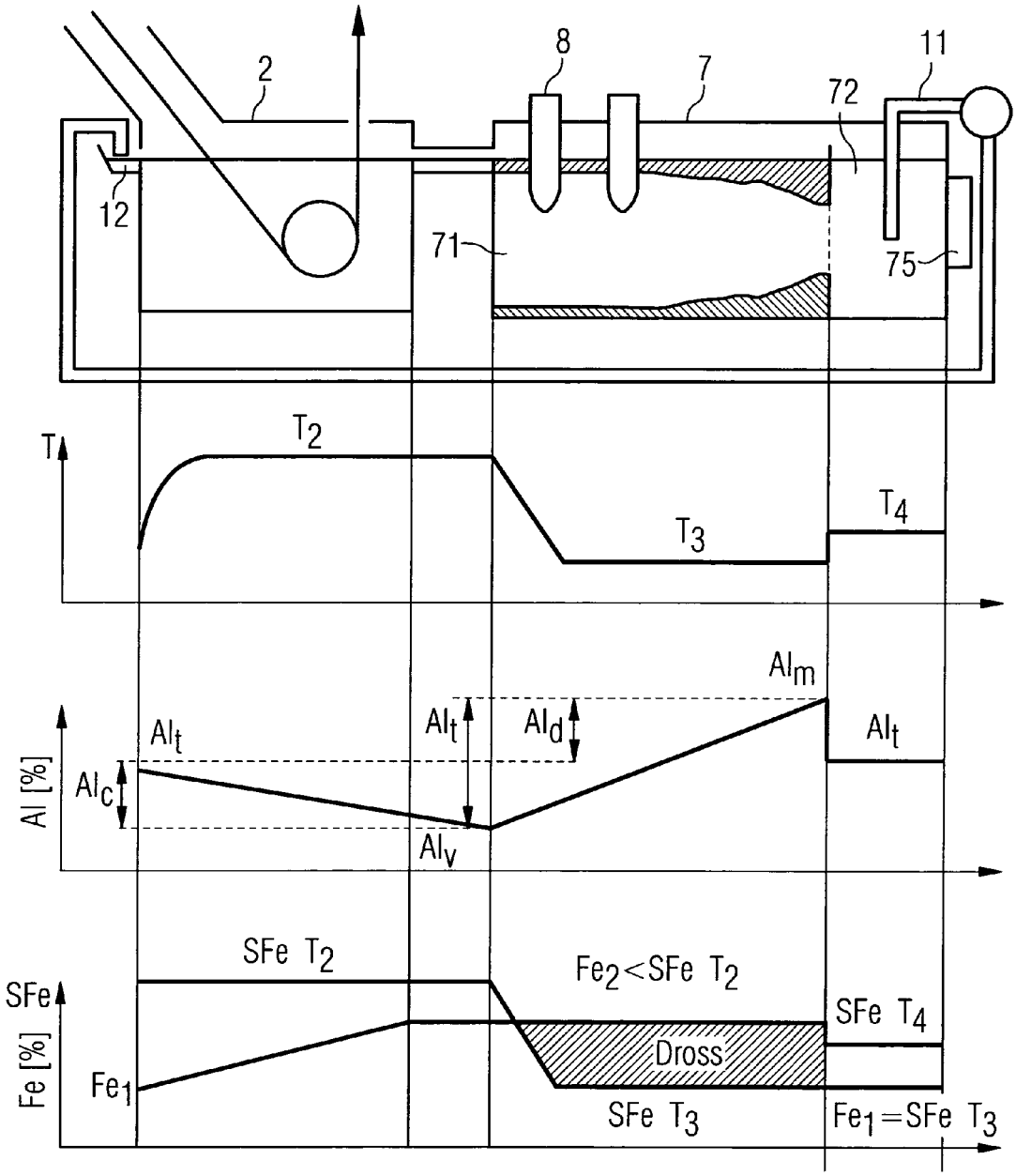
FIG. 3 shows a simplified example of an installation and distribution profiles of temperatures and aluminum and iron content dissolved in the circuit of the installation.

For reasons of clarity and according to the example of FIG. 1, the major objectives of the method according to the invention are also illustrated by means of FIG. 3:

FIG. 3 Distribution of temperatures, aluminum and iron content dissolved in the circuit of the installation.

The top part of FIG. 3 presents a simplified example of the installation according to FIG. 1, presenting the main elements already stated (coating tank 2 and its inlet 12 for liquid metal reflux, ingots 8, preparation device 7, ingot fusion tank on first zone 71, purification tank on second zone 72 and its outlet 11, heating means 75) enabling a better interpretation of the implementation of the method according to the invention.

The installation diagram also shows three distribution profiles—temperature T, dissolved aluminum content Al % and iron content Fe % associated with an iron solubility threshold SFe—which are obtained by implementing the method according to the invention. The profiles shown thus vary according to the location considered according to a flow path direction from the inlet 12 of the coating tank 2 to the outlet 11 of the purification tank 72. It should be noted that the outlet 11 is coupled to the inlet 12 by a reflux path for the liquid mixture, distinct from and opposite to the flow path. The invention thus enables the alignment of the profile values between the inlet and the outlet and between different tanks on the flow path, in order to create a closed thermal loop and to maintain the target aluminum and iron content precisely (under a suitable solubility threshold at a given temperature).

The liquid mixture in the coating tank (2) in close proximity to the strip to be hardened is fixed at a known second temperature ($T_2$). At the inlet (12) of the coating tank (2) distinct from the hardening zone, the temperature may be less high than the second temperature ($T_2$), as it comes from the outlet 11 of the purification tank (72) and the reflux path where heat loss is inevitable, but without effect on the method. Specifically, by dipping the strip in the liquid mixture of the coating tank, it is provided that the strip is at a known first temperature higher than the target second temperature ($T_2$), and that this second temperature ($T_2$) is advantageously possible to reach without difficulty, as the strip works by thermal transfer in the bath of liquid mixture. The target second temperature ($T_2$) of the liquid mixture at the coating tank outlet—and therefore at the inlet in the first zone (71)—is furthermore selected sufficiently high in order to enable fusion of the ingots (8).

The consumption of energy required to melt the ingots (8) in the first zone (71) of the preparation device (7) causes a drop in the second temperature ($T_2$) of the liquid mixture coming from the coating tank to a target value, known as the third temperature ($T_3$). In the second zone (72) of the preparation device (7), the heating means (75) provides if necessary a power ($\Delta P = PZ - PB$) which increases the temperature of the liquid mixture from the third temperature ($T_3$) to a fourth temperature ($T_4 < T_2$) which, a fortiori, is chosen sufficiently high to meet the losses on the reflux path and the temperature requirements at the inlet (12) of the coating tank. The thermal loop is therefore created in a simple manner. Only the strip and, if necessary, the heating means (75) regulate the thermal process by providing energy. If no energy provision is required at the outlet of the purification tank (72), the heating means (75) is inactivated.

Between the inlet (12) and the outlet of the coating tank (2) towards the first zone (71), the aluminum content (Al %) of the liquid mixture undergoes a drop ($Al_c$) according to a loss rate in a compound layer and passes from a first content ($Al_t$) (aluminum content of the liquid mixture from the ingots melted in the preparation device, then by purification (second zone 72) and reflux, aluminum content of the liquid mixture re-channeled towards the inlet (12) of the coating tank) to a second content ($Al_v$) at the outlet of the coating tank (2). After passing from the coating tank outlet (2), the controlled fusion of ingots creates an increase ($Al_1$) in aluminum content (or rate depending on the time unit) up to an aluminum content ($Al_m$) of the liquid mixture at the outlet of the first zone (71). This latter content ($Al_m$) must however be interpreted as theoretical, as in correlation to the aluminum added by the ingots, some of the aluminum is inevitably used due to the formation of dross which causes an actual drop ($Al_d$) in aluminum content depending on the rate at which the necessary aluminum content ($Al_t$) in the purification tank (second zone 72) is reached (and equal) to the aluminum content at the reflux inlet 12 in the coating tank.

In the coating tank (2) and under the effect of variations in temperature and aluminum content, the iron solubility threshold (SFe) in the liquid mixture is almost stable at a value (SFe $T_2$) at the second temperature ($T_2$), then decreases considerably to a value (SFe $T_3$) at the third temperature ($T_3$) in the ingot fusion zone and is subjected to an increase to a value (SFe $T_4$) at the fourth temperature ($T_4$) in the zone of the heating means (75) before returning to the coating tank (2).

The iron content (Fe %) of the liquid mixture increases in the coating tank (2) up to a level which remains lower than the iron solubility threshold (SFe $T_2$) of the liquid mixture at the second temperature ($T_2$) and is thus maintained until the precipitation of dross in the first zone (71) of ingot fusion to reach a value equal to an iron saturation threshold (SFe $T_3$) of the liquid mixture at the third temperature ($T_3$) of this first zone. A hachured zone (dross) on the diagram, between the variation curves of iron content (Fe %) and iron solubility threshold (SFe) of the liquid mixture enables the domain of dross precipitation to be located. Finally, in the second purification zone (72), the iron solubility threshold (SFe) of the liquid mixture is increased to a higher value (SFe $T_4$) at the fourth temperature ($T_4$) (higher than in the first zone 71). Precipitation of dross is thus avoided locally so that the liquid mixture in the purification tank remains purified and can flow back to the inlet of the coating tank (2) free of any dross.

Figure 4:
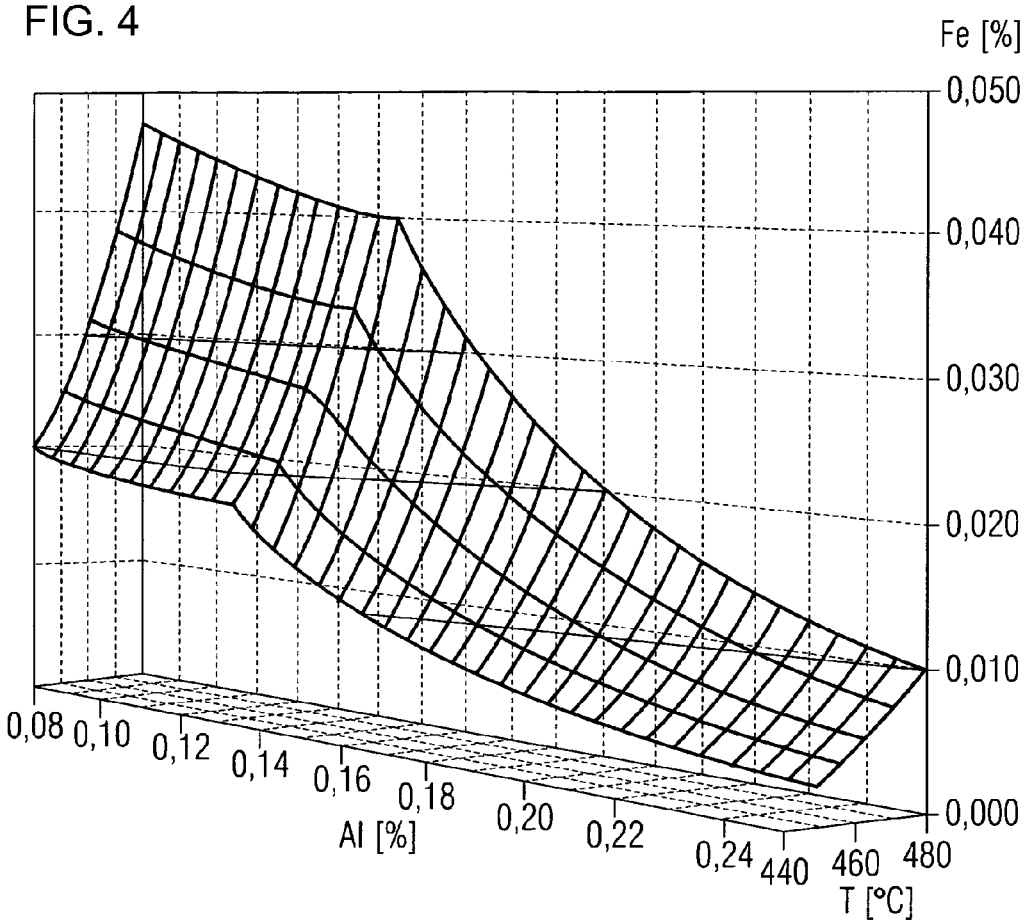
FIG. 4 is a diagram of iron solubility (Fe%) in the liquid mixture according to temperature (T) and aluminum content (A1%)
Figure 5:
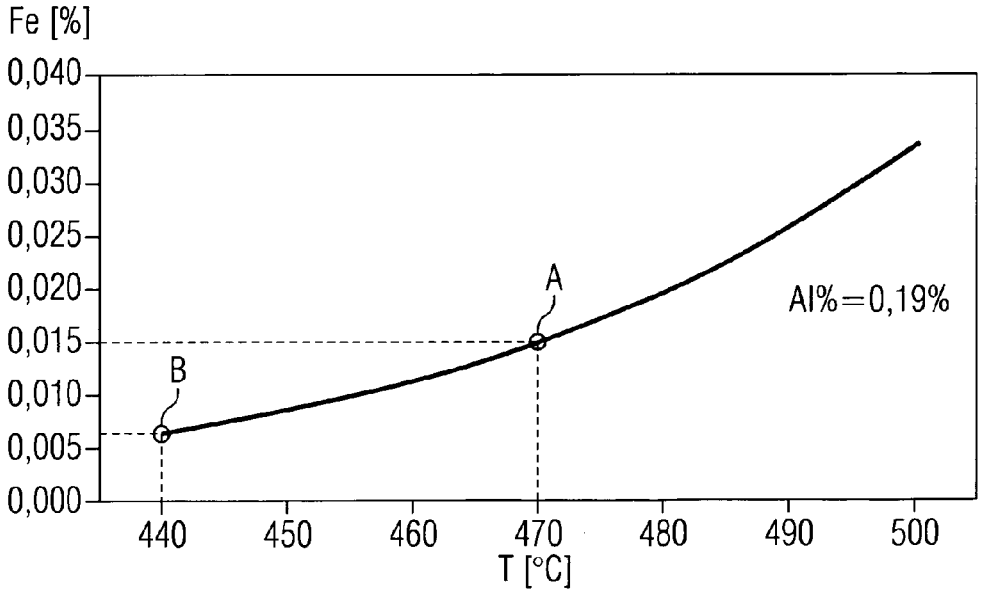
FIG. 5 shows details of the iron solubility diagram (Fe%) in the liquid mixture according to temperature (T) for a given aluminum content (Al% =0.19%)
Figure 6:
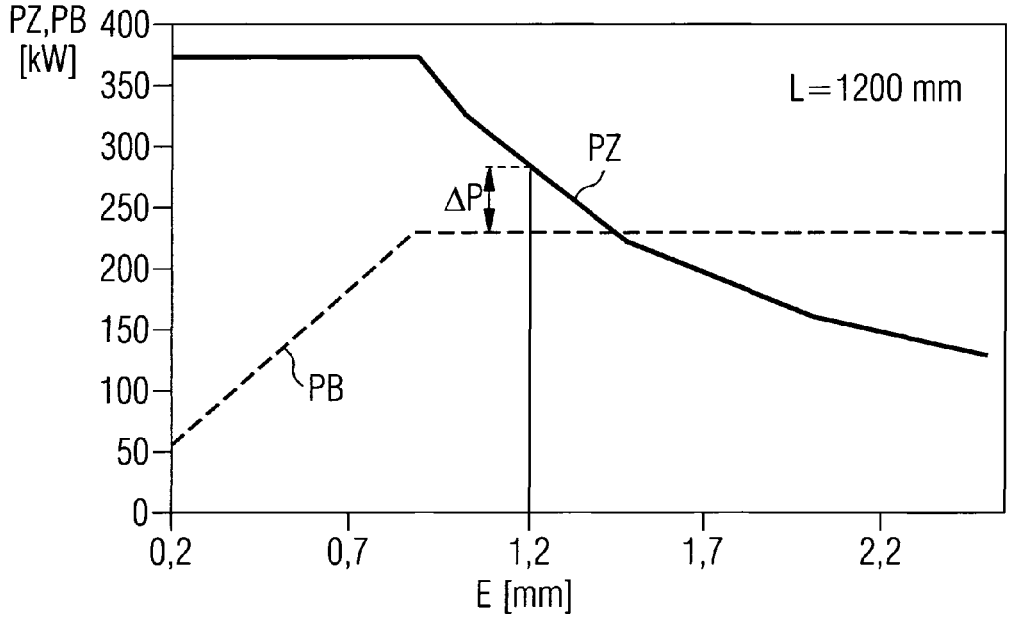
FIG. 6 is a diagram of variations in power (PB) provided to the liquid mixture by the running steel strip and power required (PZ) to ensure fusion of the liquid mixture in the coating tank (2)

Additional figures to the previous figures are also provided in order to better introduce and understand the method according to the invention:

FIG 4 diagram of iron solubility (Fe %) in the liquid mixture according to temperature (T) and aluminum content (Al %), FIG. 5 details of the iron solubility diagram (Fe %) in the liquid mixture according to temperature (T) for a given aluminum content (Al %=0.19%), FIG. 6 diagram of variations in power (PB) provided to the liquid mixture by the running steel strip and power required (PZ) to ensure fusion of the liquid mixture in the coating tank (2).

FIG. 4 shows that, for a given temperature (here between T=440 and T=480° C.), an iron solubility limit (Fe %) in the Zn—Al liquid mixture increases when the aluminum content (Al %) drops, and that at a given aluminum content, it increases with temperature. There are therefore two means of action to control the iron solubility limit: vary the aluminum content or the temperature of the liquid mixture.

FIG. 5 shows a change in the solubility limit (Fe %) according to temperature (T) for an aluminum content (Al %) of 0.19%. At a temperature T=470° C. (point A) of the coating tank (2), the iron solubility limit (Fe %) is approximately 0.015%. At a temperature T=440° C. (point B) lower than the normal content, the iron solubility limit (Fe %) is approximately 0.07%. A liquid mixture which is saturated or close to the saturation limit at the working temperature of 470° C. thus sees its solubility limit divided by 2 at 440° C. In the hypothesis where it is possible to recover all dross produced from the iron taken out of the solution at this temperature of 440° C., an iron content remaining dissolved is decreased to 0.07%. Reheating to 470° C. from this state therefore allows, without dross precipitation, an additional 0.08% of iron to be dissolved from the strip to be coated.

FIG. 6 shows the variations in power provided (PB) to the liquid mixture by the running steel strip and the power required (PZ) to ensure fusion of the mixture used in the coating tank (2). These powers (PB, PZ) are limited by two givens which are characteristic of the continuously galvanizing installation: the heating power of the furnace (not represented in FIG. 1, but placed upstream of the coating tank) on the one hand, and the maximum speed for which drying the strip remains effective. By means of example, these limits are approximately 100 tonnes of strip treated per hour for a furnace (downstream of the strip entering the coating tank) and a strip speed of just over 200 m/min for drying (outside the coating tank as the strip exits the latter). In the example shown, for a strip with a width (L) equal to 1200 mm at a strip temperature of 485° C., the curve (stippled) of so-called "strip" power (PB) increases continuously according to the thickness (E) of the strip up to a level corresponding to the heating limits of the furnace. The curve (full line) of power required (PZ) is firstly limited by the maximum running speed of the strip, itself limited by the maximum drying speed then decreases progressively. For a strip thickness (E) of 1.2 mm and coating thickness of 15 μm, the power provided (PB) by the strip is less than the power required (PZ) to melt the zinc (PZ>PB) and a power difference (ΔP) should thus be introduced by heating the liquid mixture in circulation, in particular before it returns into the coating tank (2). This power difference is therefore here understood as a necessary power contribution (ΔP>0). The case of power reduction (ΔP<0) can, of course, also be envisaged, in which case, at least one of the power generating parameters (furnace temperature, strip speed, etc.) should be modified in order to reduce the power provided (PB) to the liquid mixture whilst ensuring fusion of the mixture used in the coating tank (2). A cooling system may, if necessary, also be connected to the coating tank.

From the previous figures, it is thus possible to propose a method according to the invention, namely, a method for the hardened galvanization of a continuously-running rolled steel strip (1) in which the strip is immersed in a coating tank (2) containing a bath of a liquid metal mixture (5), such as zinc (Zn) and aluminum (Al), to be deposited on the strip, and permanently circulated between said coating tank and a preparation device (7) in which the temperature of the liquid mixture is deliberately lowered in order to reduce iron solubility and sufficiently high for initiating, in said preparation device, the fusion of at least one Zn—Al ingot (8) in an amount necessary for compensating for the liquid mixture used for deposition on the strip and inevitable losses (approximately 5%).

Said method comprises the following steps:

- determine a first power (PB) supplied by the steel strip entering at a first temperature ($T_1$) in the bath of liquid mixture of the coating tank, said bath itself being stabilized at a second predetermined temperature ($T_2$) lower than the first temperature ($T_1$),
- determine a second power (PZ) necessary to maintain the liquid mixture at the second predetermined temperature ($T_2$) and compare this second power to the first power (PB) supplied by the strip,
- if the first power (PB) is greater than the second power (PZ), assign a reduction setpoint to the first temperature ($T_1$) of the strip,
- if the first power (PB) is less than or equal to the second power (PZ), determine the energy required for continuous fusion, in the preparation device, of the ingot (8) in an amount necessary for compensating for the liquid mixture used for deposition on the strip and any other additive loss,
- set a circulating flow ($Q_2$) for the liquid mixture entering the coating tank and the preparation device in order to provide the necessary energy for continuous fusion of the ingot (8) whilst maintaining the temperature of the liquid mixture in the preparation device at a third predetermined temperature ($T_3$) lower than the second predetermined temperature ($T_2$),
- set a fourth temperature ($T_4$) of the liquid mixture at the outlet (9) of the preparation device in order to provide additional power (ΔP=PZ−PB) necessary for a thermal equilibrium between said outlet and the supply inlet (12) of the coating tank, said inlet being supplied by the outlet (9).

In that way, the method enables a continuous and sequential circulating flow of liquid mixture through a flow path between the coating tank inlet and the preparation device outlet then through an identical reflux path which is in the opposite direction and distinct to the flow path. This circulating flow is also thermally optimized, as it is sequentially looped (flow, reflux) so that each heat exchange required is controlled in a precise manner.

Control of the second temperature ($T_2$) and target aluminum content ($Al_v$) enables the control of the iron solubility threshold (SFe $T_2$) at the second temperature ($T_2$) in the bath (coating tank) at a level such that, considering the iron dissolution rate (QFe) expected in the coating tank, the total iron content ($Fe_2$) is maintained lower than the iron solubility threshold (SFe $T_2$) at the second temperature ($T_2$). In this way, the coating tank remains free of any dross; the coating is of perfect quality. To this effect, by adjusting the second temperature ($T_2$) and the target aluminum content ($Al_v$), an iron solubility threshold (SFe $T_2$) at the second temperature ($T_2$) in the liquid mixture of the coating tank is controlled at a level such that, considering an iron dissolution rate (QFe) expected in the coating tank, a total iron content ($Fe_2$) is maintained lower than the iron solubility threshold (SFe $T_2$) at the second temperature ($T_2$).

It is preferable that the continuous fusion of ingots is ensured at a total fusion rate ($V_m$) of at least two ingots.

In accordance with the fusion, as in FIG. 1 (or 2), a variable number (n) of ingots may advantageously be immersed in a selective manner and simultaneously into the bath of liquid mixture. The ingots each preferably have an aluminum content ($Al_l$, $Al_2$, . . . , $Al_n$) different from each other and at least one of the ingots comprises an aluminum content greater than the content ($Al_t$) required in the preparation device (in particular in the second zone 72 comprising the pure mixture). In this manner, maintaining or achieving a target value of aluminum content in the preparation device zones may be done more flexibly and more precisely.

For this plurality (n) of ingots, an immersion speed ($V_1$, $V_2$, . . . , $V_n$) of each of the (n) ingots may also be controlled individually, so that the aluminum content in the preparation device can be adjusted dynamically to the required content ($Al_t$) whilst maintaining the total fusion speed (=rate) required.

If necessary, a cooling means for the liquid mixture from the second temperature ($T_2$) to the third temperature ($T_3$) may be activated in the preparation device as an additional cooling assembly system performed by fusion of the ingots. Such additional cooling means thus enables the method according to the invention to be controlled with more flexibility.

A compartment between the ingots and according to their respective aluminum content may advantageously be added in order to separate different types of dross, such that so-called "surface" dross with a high aluminum content forms preferentially in close proximity to the immersed ingots with a high aluminum content and so-called "bottom" dross with a low aluminum content forms preferentially in close proximity to the immersed ingots with a low aluminum content. This compartmentation may be achieved simply by adding partitions disposed between the ingots on the surface and at the bottom of the first zone (71).

The method according to the invention provides that a necessary flow of liquid zinc, in other words, also for replenishing the liquid mixture entering the coating tank, is regulated below an iron content equal to the iron solubility threshold (SFe $T_3$) at the third temperature ($T_3$) in order to limit an increase in the iron content dissolved considerably below the solubility threshold at the second temperature ($T_2$) in the coating tank. This enables an amount of iron dissolved from the strip to be tolerated between the iron solubility threshold (SFe $T_3$) at the third temperature ($T_3$) and the iron solubility threshold (SFe $T_2$) at the second temperature ($T_2$).

A regulation loop of the first power (PB) supplied by the strip controls an increase or decrease in power ($\Delta P$) resulting in a equilibrium such that the first power (PB) is equal to the sum of the second power (PZ) and the increase or decrease in power ($\Delta P$), in other words, such that PB=PZ +$\Delta P$. This is achieved by sending a reduction (or increase) setpoint to the temperature of the strip ($T_1$) at the inlet of the coating tank.

The method provides that the preparation device is equipped with additional regulated means for recovering and discharging calories associated with a regulated heating means by induction adapted to adjust the third temperature ($T_3$) in an ingot fusion zone and within a temperature interval, particularly defined by +/−10° C., to values close to a temperature value set by the regulation means or external control means.

Thermally, the method recommends that the first temperature ($T_1$) of the steel strip as it enters the coating tank is ideally between 450 and 550° C. Similarly, the second temperature ($T_2$) of the liquid mixture in the coating tank is ideally between 450 and 520° C. For the method to be maximally effective, a temperature difference ($\Delta T_1$) between the steel strip and the liquid mixture in the coating tank is maintained between 0 and 50° C. The second temperature ($T_2$) of the liquid mixture is thus maintained in the coating tank, ideally at an accuracy of +/−1 at 3° C., at a value ($T_1$-$\Delta T_1$) equal to the first temperature ($T_1$) reduced by the temperature difference ($\Delta T_1$) between the steel strip and the liquid mixture. Finally, a temperature decrease ($\Delta T_2$=$T_2$−$T_3$) between the second and third temperature of the liquid mixture in the preparation device is maintained at at least 10° C. These values enable, for zinc, aluminum and iron content, an optimal thermal loop on the circulating circuit (flow/reflux) implemented by the galvanization method according to the invention.

The method provides that a circulating rate ($Q_2$) of the liquid mixture coming from the coating tank is maintained between 10 and 30 times the quantity of mixture deposited on the strip in the same time unit.

The method according to the invention also provides for the implementation of measuring and control steps enabling the regulation/maintenance of the thermal loop, the circulating circuit and the target aluminum, zinc and iron contents.

In particular, the temperature values and values of aluminum concentration in the liquid mixture are measured, ideally continuously, on at least the flow path from the supply inlet (12) in the coating tank to the outlet (11) of the preparation device. These values are essential in order to associate them with the diagrams of aluminum or iron content according to the location of the liquid mixture in the circulating circuit to be looped.

A level of liquid mixture is measured, ideally continuously, in the preparation device and if necessary, even in the coating tank. This enables the ingot fusion rate to be regulated and the amount of metal deposited on the strip to be known.

In practice, a rate (for example an aluminum content per time unit) and a temperature of the liquid mixture are maintained at predetermined pairs of values by means of simplified regulation. This enables, for example, the simple deduction of a diagram (such as those in FIGS. 1 and 2) and an ideal (iron) solubility threshold to be reached quickly for a pair of values.

The method includes a function in which a temperature of the strip at the outlet of a galvanizing furnace linked to a strip entering the coating tank is maintained within an interval of adjustable values. In the same way, the running speed of the strip is maintained within an interval of adjustable values. Ideally, the method provides that a width and thickness of strip are measured or estimated upstream of the coating tank, if, however, they are not already collected as primary input parameters (Primary Data Input PDI) in the control system for the galvanizing installation. These parameters are useful for determining input conditions, in particular in relation to the power supplied by the strip in the circulating circuit managed by the method according to the invention.

In order to be able to adjust the fusion speed of each of the ingots, the ingots are introduced and maintained in a fusion zone of the preparation device in a dynamic and selective manner.

The method according to the invention is thus implemented according to the dynamic measuring and adjusting parameters linked to the strip, the coating tank and the preparation device. These parameters are ideally controlled centrally, in an autonomous manner according to an analytical model with predictive controls, in real time, and being optionally updated by auto-programming. To these, an external control mode may also be implemented (for example, through simple inputting of external controls on the analytical model controlling said method) so that, for example an operator may be able to adjust the aluminum content or adjust the temperature of the strip, etc. In line with such external controls, the analytical model for regulating the method is also updated again.

In the same way as for parameters from a galvanizing furnace upstream of the coating tank, measuring and adjusting parameters from a drying method of the strip running outside the coating tank may be supplied to control the method according to the invention. This enables the pre-adjusting values to be better calibrated such as in connection with the coating thickness and the required metal content to be deposited.

A group of sub-claims thus present the advantages of the invention.

Figure 7:
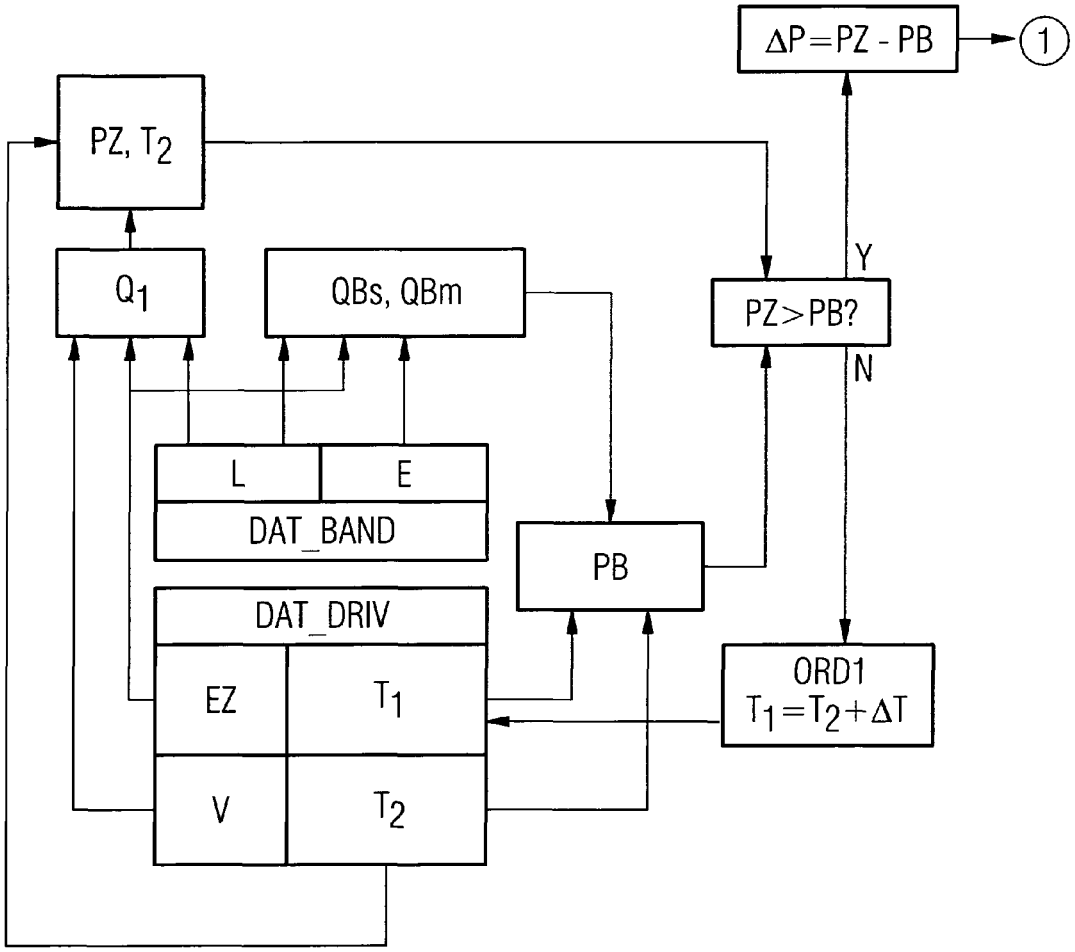
FIG. 7 presents a logic diagram for determining the powers.
Figure 9:
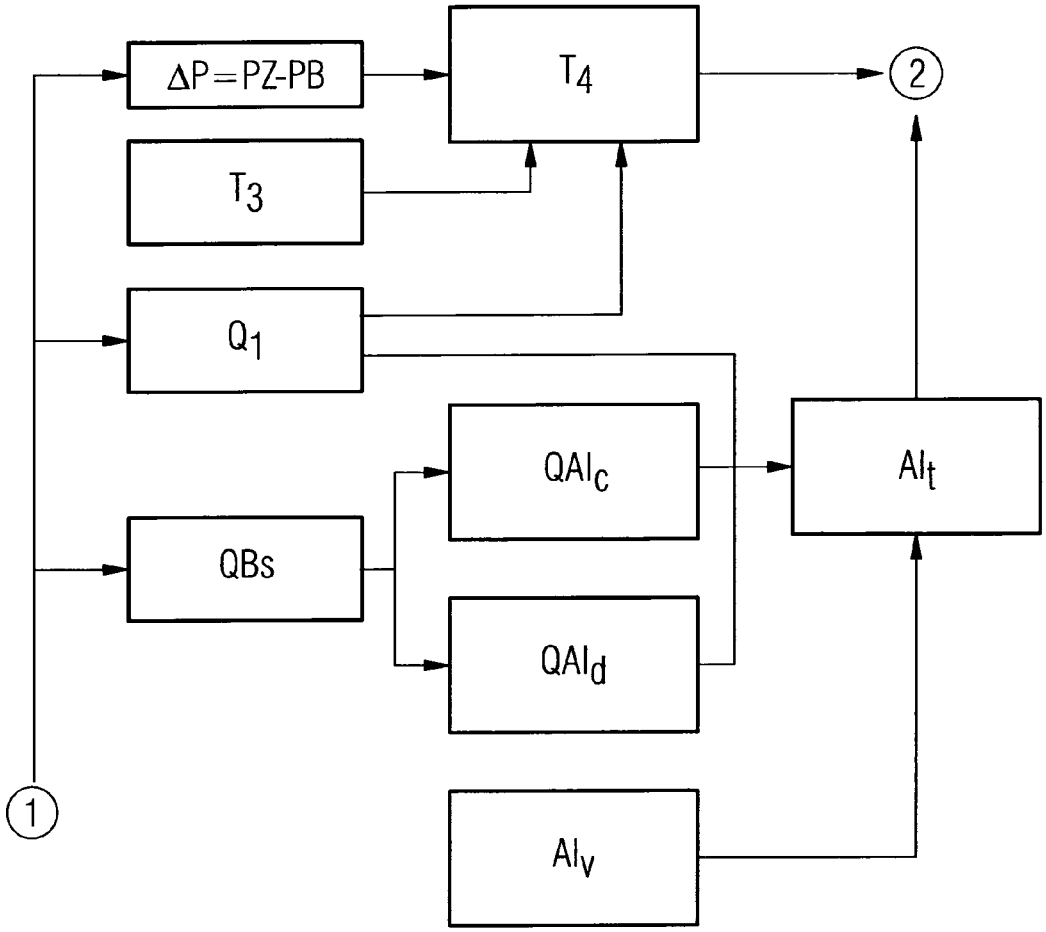
FIG. 9 shows a logic diagram for determining the aluminum content.
Figure 10:
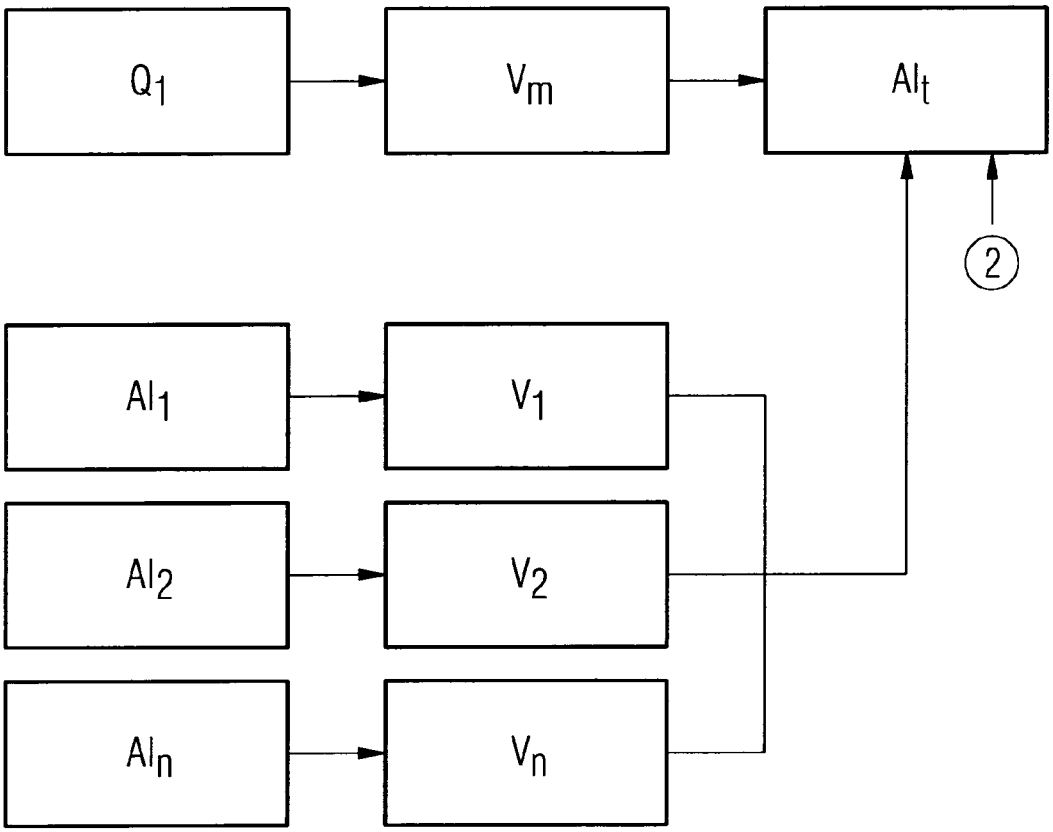
FIG. 10 shows a logic diagram for determining the ingot fusion speed.
Figure 11:
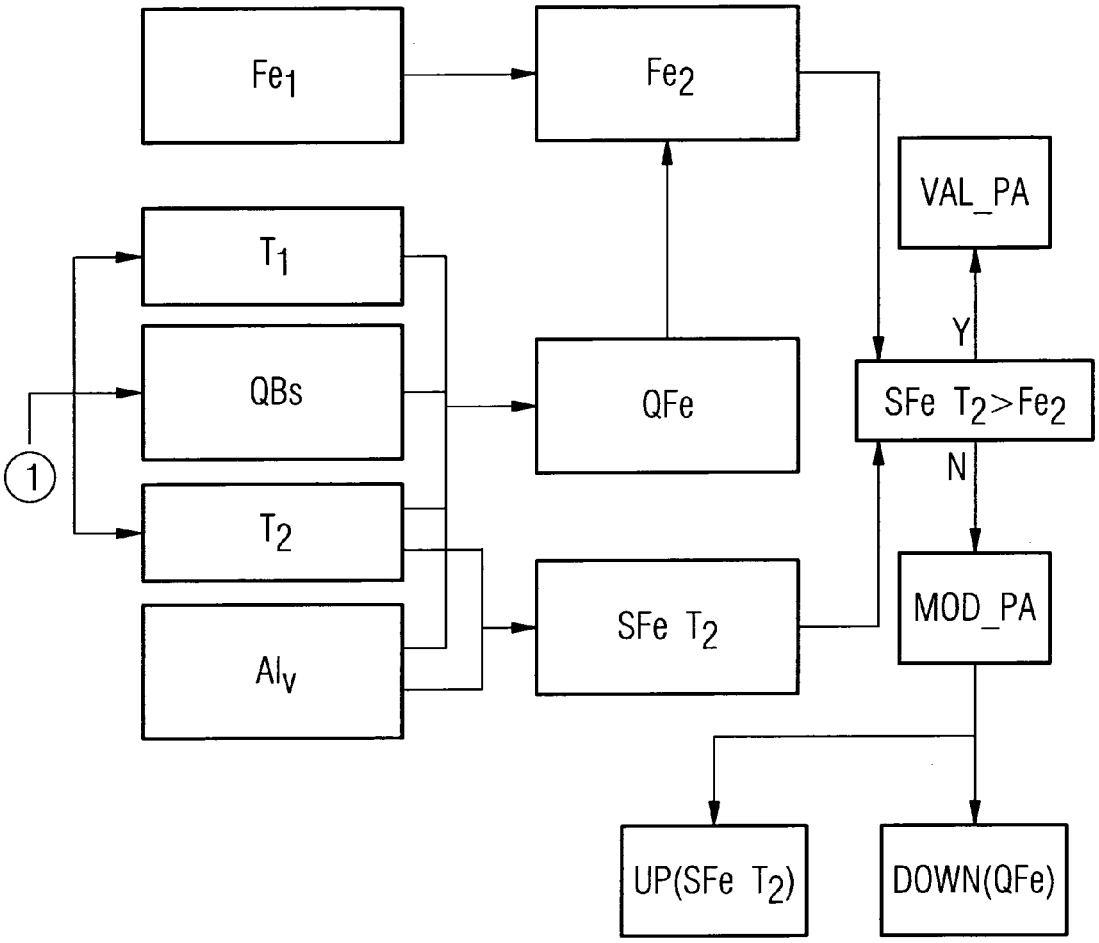
FIG. 11 shows a logic diagram for checking the theoretical iron content dissolved in the liquid mixture.

Examples of embodiments and applications for implementing the method are provided using the preceding figures and the following figures:

FIG. 7 logic diagram for determining the powers, logic diagram for determining the circulating rate of a liquid mixture, FIG. 9 logic diagram for determining the aluminum content, FIG. 10 logic diagram for determining the ingot fusion speed, FIG. 11 logic diagram for checking the theoretical iron content dissolved in the liquid mixture.

FIG. 7 presents the logic diagram for determining the strip power (PB) and power required (PZ) brought into play to implement the method according to the invention. Using the data affecting the product (DAT_BAND) and the driving conditions (DAT_DRIV) of the installation (see FIGS. 1, 2 and 3) namely,

- the width (L) and the thickness (E) of the continuously running strip,
- the thickness of zinc (EZ) deposited on the two faces of the strip and target speed (V) of the strip The mass flow (QBm) and surface flow (QBs) of the strip and a total rate of zinc used including inevitable losses are calculated.

The power of the strip (PB) and required power (PZ) are calculated based on these rates, the first temperature ($T_2$) of the strip at the outlet of the galvanizing furnace downstream of the coating tray and the second target temperature ($T_2$) in the coating tank.

If, as in the case of FIG. 6, the power required is greater than the power of the strip (PZ>PB, case "Y"), it is processed after the calculations (see FIG. 8) in the form: ΔP=PZ=PB (step "1").

In the contrary case, the power required may also be less than the power of the strip (PZ<PB, case "N"). The method according to the invention provides for a cooling (ΔT) setpoint (ORD1) for the first temperature of the strip ($T_1$) by means of a reduction in temperature at the outlet of the galvanizing furnace. At the end of this step, the temperature of the liquid mixture in the coating tank must return to its value ($T_2$) given that the temperature of the strip ($T_1$) at the inlet of the coating tank is equal to the second temperature ($T_2$) increased by a determined value, here the absolute cooling value (ΔT), in other words:

$$T_1=T_2+\Delta T.$$

Figure 8:
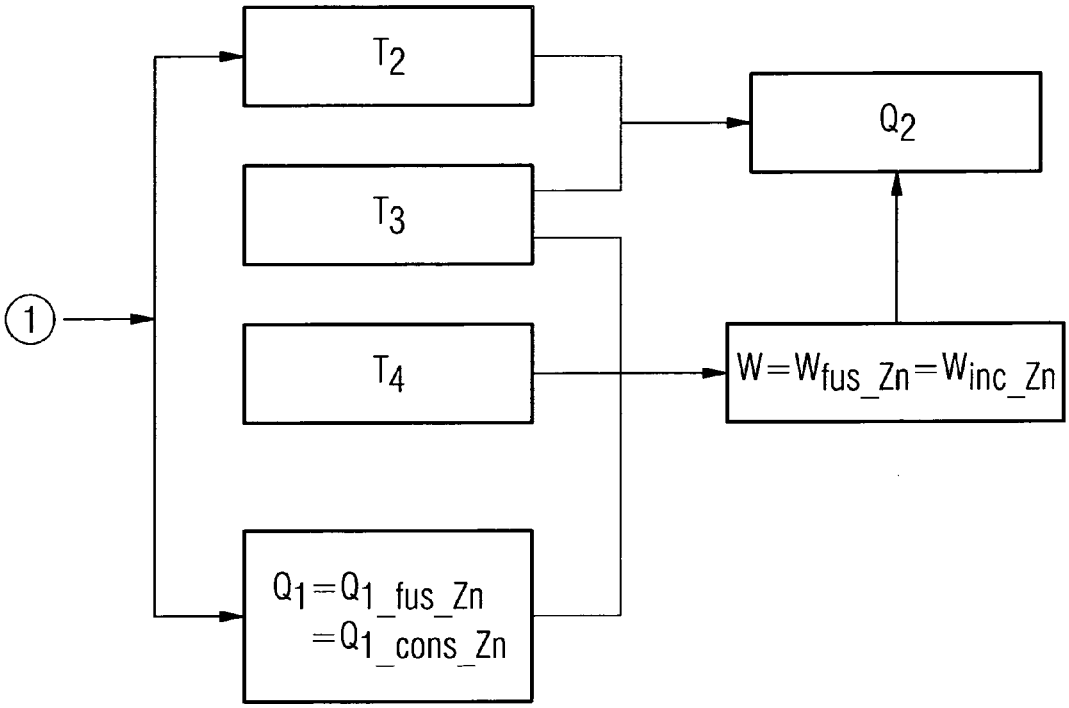
FIG. 8 presents a logic diagram for determining the circulating rate of a liquid mixture.

FIG. 8 presents the logic diagram for determining the circulating rate of the liquid mixture, associated after step "1" in FIG. 7, also represented as a logic starting point in the present diagram. From the third target temperature ($T_3$) in the ingot fusion zone (71) of the preparation device, an initial ingot temperature ($T_L$), the latter being able to be reheated, if necessary, before their introduction into the liquid mixture, and the rate ($Q_1$) of zinc used and being compensated for by ingot fusion, it is possible to determine the fusion energy ($W=W_{fus_Zn}$) of said zinc ingots. This energy (W) also represents the energy ($W_{inc_Zn}$) to be supplied by the liquid zinc from the coating tank.

Taking into account the second temperature ($T_2$) of the liquid mixture coming from the coating tank and the energy (W) previously calculated, the rate ($Q_2$) of liquid mixture coming from the coating tank and necessary to ensure the continuous fusion of ingots is determined. This rate ($Q_2$) also indicates the circulating rate of liquid mixture between the coating tank and the preparation device.

FIG. 9 shows the logic diagram for determining the aluminum content ($Al_t$) of the liquid mixture from the fusion of ingots in the preparation device (purification tank 72).

Specifically, the formation of defined Fe—Al compounds which, on the one hand, form the compound layer deposited on the strip and which, on the other hand, are present in the dross leading to the consumption of aluminum, respectively ($QAl_c$) and ($QAl_d$) which adds to the quantity normally deposited, with zinc, on the strip. This additional consumption must be compensated for by an aluminum content ($Al_t$) in the purification tank (72) slightly higher than the target aluminum content ($Al_v$) in the coating tank. The consumption of aluminum ($QAl_c$) and ($QAl_d$) is calculated based on the mass flow (QBm) of the strip. They are also included in the diagram for calculating the fourth temperature ($T_4$) of the liquid mixture returning into the coating tank according to the third temperature ($T_3$) obtained after fusion of the ingots and the additional power (ΔP) necessary to raise the temperature of the liquid mixture to the second temperature ($T_2$) in the coating tank. The value of the aluminum content ($Al_t$) of the liquid mixture is then known in terms of consumption to move on to step "2" according to the next figure.

FIG. 10 shows the logic diagram for determining the ingot fusion speed (=rate) in the preparation device. Depending on a an amount of aluminum losses ($QAl_c$) in the compound layer and aluminum losses ($QAl_d$) in the dross which vary in particular according to the width of the strip processed, it is necessary to be able to adapt the aluminum content ($Al_t$) from ingot fusion in order to maintain, during reflux, a target aluminum content value ($Al_v$) in the coating tank. To this end, it is therefore advantageous to be able to dip dynamically, selectively and simultaneously into the liquid mixture of the preparation device at least two ingots with a different aluminum content and of which at least one comprises an aluminum content greater than the aluminum content ($Al_t$) in the second zone (72) of the preparation device. A plurality of (n) ingots is then immersed in the liquid metal at a total fusion speed (=rate) ($V_m$) corresponding to the total calculated rate of zinc used. Each of the (n) ingots with an aluminum content ($Al_1$, $Al_2$, . . . $Al_n$) is immersed selectively and according to a dynamic (length of immersion) which can be variably adapted to each ingot associated with a fusion speed ($V_1, V_2, \ldots, V_n$) calculated in order to ensure a resulting aluminum content ($Al_t$) linked to the total fusion speed ($V_m$) and in order to monitor that the required aluminum content ($Al_t$) related to the predicted aluminum consumption according to the value from step "2" in the previous FIG. 9 is ensured by the aluminum content ($Al_t$) from ingot fusion.

FIG. 11 shows the logic diagram for checking the theoretical iron content (SFe) dissolved in the liquid mixture from step "1" described previously (see FIGS. 6, 7, 8). The iron content ($Fe_1$) of the liquid mixture entering the coating tank is fixed by the iron solubility threshold (SFe $T_3$) at the third temperature ($T_3$) of dross precipitation ($Fe_1$=SFe $T_3$) (see also FIG. 1). Depending on the data such as the first temperature ($T_1$) of the strip entering the coating tank inlet, the second temperature ($T_2$) of the liquid mixture in said coating tank, the surface flow of the strip (QBs) and the aluminum content of the liquid mixture entering the preparation device, the method uses a calculation, on the one hand, of iron dissolution rate (QFe) from the two faces of the running strip, and on the other hand, of the iron solubility threshold (SFe $T_2$) in the liquid mixture at the second temperature ($T_2$). This dissolution rate, added to the iron content ($Fe_1$) at the inlet of the coating tank enables the iron content of the liquid mixture ($Fe_2$) to be calculated such that:

$$Fe_2=(QFe.SFe)+Fe_1$$

in which a safety factor ($S_{Fe}$) is introduced. A high iron concentration gradient develops on the surface of the strip favoring the creation of a compound $Fe_2Al_5Zn_x$ layer. The iron content of the liquid mixture ($Fe_2$) in the coating tank is then the iron content at the end of said gradient and may be considered as the total iron content of the liquid mixture bath. If the iron solubility threshold (SFe $T_2$) in the liquid mixture at the second temperature ($T_2$) is greater than the actual iron content of the liquid mixture ($Fe_2$) in the coating tank (see case "SFe $T_2$>$Fe_2$"), the different regulation parameters accepted for the method are validated (see case "VAL_PA").

In the contrary case, these parameters must be modified (see case "MOD_PA") with a view to increase (case "UP (SFe $T_2$)") the iron solubility threshold (SFe $T_2$) in the liquid mixture at the second temperature ($T_2$) and/or reduce (case "DOWN(QFe)") the iron dissolution rate (QFe). The increase in said solubility threshold (SFe $T_2$) is obtained by increasing the second temperature ($T_2$) and/or reducing the aluminum content ($Al_v$) in the coating tank. The iron dissolution rate (QFe) is reduced by reducing the first temperature ($T_1$) and/or the second temperature ($T_2$) and/or the surface flow of the strip (QBs) and/or by increasing the aluminum content ($Al_v$) in the coating tank. In practice, it is preferable to change the first temperature ($T_1$) of the strip and/or its running speed (V).

LIST OF MAIN ABBREVIATIONS

1 continuously running strip
2, 13 coating tank
7 preparation device
71, 72 first and second zones of the preparation device
8 ingot(s)
A point of iron solubility limit at 470 ° C. for an aluminum content of 0.19 %
Al Aluminum
$Al_1, \ldots, Al_n$ aluminum content of ingots 1 to n
$Al_c$ Aluminum content in the compound layer
$Al_d$ Aluminum content in dross
$Al_l$ increase in aluminum content of the liquid mixture required in the preparation device
$Al_m$ maximum (theoretical) aluminum content of the liquid mixture in the preparation device (first zone 71)
$Al_t$ aluminum content of the liquid mixture from ingots melted in the preparation device (therefore, in second zone 72)
$Al_v$ target aluminum content of the liquid mixture at the coating tank outlet
B point of iron solubility limit at 440° C. for an aluminum content of 0.19%
DAT_BAND strip data
DAT_DRIV driving data
DOWN(x) decrease variable x
Dross Matte, Dross
ΔP increase (ΔP>0) or decrease (ΔP<0) in power
ΔT positive (ΔT>0) or negative (ΔT<0) variation in temperature corresponding to an increase or decrease in energy
E thickness of strip
EZ thickness of zinc
Fe iron
$Fe_1$ iron content of the liquid mixture at the coating tank inlet
$Fe_2$ maximum iron content of the liquid mixture in the coating tank
L width of strip
MOD_PA modification of parameters chosen
N no
ORD1 setpoint
PZ power necessary for maintaining zinc at T2
PB power supplied by the strip
$Q_1=Q_{1_fus_zn}$ fusion rate of zinc ingots
$=Q_{1_cons_Zn}$ total zinc-aluminum rate consumed
$Q_2$ necessary rate of liquid zinc at coating tank outlet
$QAl_c$ Al loss rate in compound layer
$QAl_d$ Al loss rate in dross
QBm mass flow of strip
QBs surface flow of strip
QFe iron dissolution rate in the liquid mixture
SFe solubility/saturation threshold of iron in the liquid mixture
SFe $T_2$ SFe for liquid mixture at temperature $T_2$
SFe $T_3$ SFe for liquid mixture at temperature $T_3$
SFe $T_4$ SFe for liquid mixture at temperature $T_4$
$T_1$ $1^{st}$ temperature of strip at coating tank inlet
$T_{1\ mes}$ $T_1$ measured
$T_2$ $2^{nd}$ temperature of liquid mixture in the coating tank
$T_3$ $3^{rd}$ temperature of preparation device (bath)
$T_4$ $4^{th}$ temperature of liquid at purification tank outlet
$T_L$ initial temperature of zinc ingots before immersion in fusion zone
UP(x) increase variable x
V strip running speed
$V_m$ total fusion rate of immersed ingots
$V_{max}$ maximum running speed of strip
$V_1, \ldots, V_n$ ingot fusion rates 1 to n
VAL_PA validation of parameters chosen
$W=W_{fus_Zn}$ zinc ingot fusion energy
$=W_{inc_Zn}$ energy to be provided by the liquid zinc from the coating tank
Y yes
Zn zinc

The invention claimed is:

1. A method for a hardened galvanization of a continuously-running rolled steel strip, which comprises the steps of:

immersing the steel strip in a coating tank containing a bath of a liquid metal mixture to be deposited on the steel strip;

permanently circulating the liquid metal mixture sequentially between the coating tank, a first zone of a preparation device and a second zone of the preparation device, the second zone sequentially juxtaposed to the first zone and including a flow path for returning liquid metal mixture to the coating tank, wherein a temperature of the liquid metal mixture is deliberately lowered in order to reduce an iron solubility threshold and sufficiently high for initiating, in the first zone of the preparation device, fusion of at least one Zn—Al ingot in an amount necessary for compensating for the liquid metal mixture used for deposition on the steel strip, and the first zone and second zone are one of: two zones located in the same tank and separated by a separating device including an opening located between the upper decanting zone of surface dross and the lower sedimentation zone of bottom dross, or two separate tanks placed side by side with the liquid mixture being transferred from a middle portion of the first zone between the upper decanting zone of surface dross and the lower sedimentation zone of bottom dross by pumping or by a connecting channel;

determining a first power supplied by the steel strip entering at a first temperature in the bath of the liquid metal mixture of the coating tank, the bath itself being stabilized at a second predetermined temperature lower than the first temperature;

determining a second power necessary to raise the liquid metal mixture to the second predetermined temperature and compare the second power to the first power supplied by the steel strip;

as a result of determining that the first power is greater than the second power, reducing the first power supplied to the bath by the steel strip by at least modifying a running speed of the steel strip;

determining energy required for continuous fusion, in the preparation device, of the ingot in an amount necessary for compensating for the liquid metal mixture used for deposition on the steel strip if the first power is less than or equal to the second power;

setting a circulating rate for the liquid metal mixture between entering the coating tank and the preparation device to provide the necessary energy for the continuous fusion of the ingot while maintaining the temperature of the liquid metal mixture in the preparation device at a third predetermined temperature lower than the second predetermined temperature;

setting a fourth temperature of the liquid metal mixture at an outlet of the preparation device in order to provide additional power necessary for a thermal equilibrium between the outlet and a supply inlet of the coating tank, the supply inlet being supplied by the outlet;

immersing a plurality of ingots having different aluminum contents selectively and simultaneously in the bath of the liquid metal mixture; and individually controlling an immersion speed of each of the ingots, in order to adjust the aluminum content in the preparation device to the required content, the plurality of ingots being immersed in the bath of the liquid metal mixture at a total fusion rate corresponding to a total calculated rate of zinc used.

2. The method according to claim 1, which further comprises by means of adjusting the second predetermined temperature and a target aluminum content, controlling the iron solubility threshold at the second predetermined temperature in the liquid metal mixture of the coating tank at a level such that, given an expected iron dissolution rate in the coating tank, a total iron content is maintained lower than the iron solubility threshold at the second predetermined temperature.

3. The method according to claim 1, wherein a continuous fusion of ingots is ensured at a total fusion rate of at least two ingots.

4. The method according to claim 3, wherein a compartmentation between the ingots and according to the aluminum content is achieved in order to separate different types of dross, such that so-called "surface" dross with a high aluminum content forms in close proximity to an immersed ingots with a high aluminum content and so called "bottom" dross with a low aluminum content forms in close proximity to immersed ingots with a low aluminum content.

5. The method according to claim 3, wherein at least one of the ingots has an aluminum content greater than a required content in the preparation device.

6. The method according to claim 1, which further comprises activating a cooling of the liquid steel mixture from the second predetermined temperature to the third predetermined temperature in the preparation device to lower the iron solubility threshold and to localize a formation of dross in the preparation device.

7. The method according to claim 1, which further comprises regulating a replenishing flow of the liquid metal mixture entering the coating tank below an iron content equal to the solubility threshold at the third predetermined temperature in order to limit an increase in a dissolved iron content to below the solubility threshold at the second predetermined temperature in the coating tank.

8. The method according to claim 1, wherein a regulation loop of the first power PB supplied by the steel strip controls an increase or decrease in power provided $\Delta P$, reaching an equilibrium such that the first power PB is equal to a sum of the second power PZ and the increase or decrease in power provided $\Delta P$, such that $PB = PZ + \Delta P$, and at a temperature setpoint of the steel strip.

9. The method according to claim 1, which further comprises equipping the preparation device with regulated means for recovering and discharging calories associated with a regulated heating means by induction adapted to adjust the third predetermined temperature in the ingot fusion zone and within a temperature interval with values close to a temperature value setpoint.

10. The method according to claim 9, which further comprises setting the temperature interval to be +/−10° C.

11. The method according to claim 1, which further comprises setting the first temperature of the steel strip as it enters the coating tank to be between 450 and 550° C.

12. The method according to claim 11, which further comprises maintaining a temperature difference between the steel strip and the liquid metal mixture in the coating tank between 0 and 50 ° C.

13. The method according to claim 12, which further comprises maintaining the second predetermined temperature of the liquid metal mixture in the coating tank, at an accuracy of +/−1 at 3° C., at a value equal to the first temperature reduced by the temperature difference between the steel strip and the liquid metal mixture.

14. The method according to claim 11, which further comprises maintaining a decrease in temperature between the second and third predetermined temperature of the liquid metal mixture in the preparation device of at least 10° C.

15. The method according to claim 1, which further comprises setting the second predetermined temperature of the liquid metal mixture in the coating tank to be between 450 and 520° C.

16. The method according to claim 1, which further comprises maintaining a circulating flow of the liquid metal mixture from the coating tank between 10 and 30 times a quantity of mixture deposited on the steel strip within a same time unit.

17. The method according to claim 1, which further comprises measuring a temperature and aluminum concentration values of the liquid metal mixture, continuously, on at least one flow path from the supply inlet in the coating tank up to the outlet of the preparation device.

18. The method according to claim 1, which further comprises measuring a liquid mixture level, continuously, in the preparation device.

19. The method according to claim 1, which further comprises maintaining a flow and a temperature of the liquid metal mixture at predetermined pairs of values by means of regulation.

20. The method according to claim 1, wherein a temperature of the steel strip exiting a galvanizing furnace linked to a steel strip entering the coating tank is maintained within an adjustable range of values.

21. The method according to claim 1, which further comprises maintaining a running speed of the steel strip within an adjustable range of values.

22. The method according to claim 1, which further comprises measuring a width and a thickness of the steel strip upstream of the coating tank.

23. The method according to claim 1, wherein an introduction and maintenance of ingots in a fusion zone of the preparation device is performed dynamically.

24. The method according to claim 1, which further comprises centrally controlling a plurality of dynamic measuring and adjusting parameters linked to the steel strip, the coating tank and the preparation device.

25. The method according to claim 1, wherein control parameters are readjusted through an input of external controls into an analytical model controlling the method.

26. The method according to claim 25, wherein the analytical model is updated by auto-programming.

27. The method according to claim 1, which further comprises forming the liquid metal mixture from zinc and aluminum.

28. A method for a hardened galvanization of a continuously-running rolled steel strip, which comprises the steps of:

immersing the steel strip in a coating tank containing a bath of a liquid metal mixture to be deposited on the steel strip;

permanently circulating the liquid metal mixture sequentially between the coating tank, a first zone of a preparation device and a second zone of the preparation device, the second zone sequentially juxtaposed to the first zone and including a flow path for returning liquid metal mixture to the coating tank, wherein a temperature of the liquid metal mixture is deliberately lowered in order to reduce an iron solubility threshold and sufficiently high for initiating, in the first zone of the preparation device, fusion of at least one Zn—Al ingot in an amount necessary for compensating for the liquid metal mixture used for deposition on the steel strip, and the first zone and second zone are one of:

two zones located in the same tank and separated by a separating device including an opening which is in the middle third of the height of the zone, or two separate tanks placed side by side with the liquid mixture being transferred from a portion in the middle third of the height of the first zone by pumping or by a connecting channel;

determining a first power supplied by the steel strip entering at a first temperature in the bath of the liquid metal mixture of the coating tank, the bath itself being stabilized at a second predetermined temperature lower than the first temperature;

determining a second power necessary to raise the liquid metal mixture to the second predetermined temperature and compare the second power to the first power supplied by the steel strip;

as a result of determining that the first power is greater than the second power, reducing the first power supplied to the bath by the steel strip by at least modifying a running speed of the steel strip;

determining energy required for continuous fusion, in the preparation device, of the ingot in an amount necessary for compensating for the liquid metal mixture used for deposition on the steel strip if the first power is less than or equal to the second power;

setting a circulating rate for the liquid metal mixture between entering the coating tank and the preparation device to provide the necessary energy for the continuous fusion of the ingot while maintaining the temperature of the liquid metal mixture in the preparation device at a third predetermined temperature lower than the second predetermined temperature;

setting a fourth temperature of the liquid metal mixture at an outlet of the preparation device in order to provide additional power necessary for a thermal equilibrium between the outlet and a supply inlet of the coating tank, the supply inlet being supplied by the outlet;

immersing a plurality of ingots having different aluminum contents selectively and simultaneously in the bath of the liquid metal mixture; and individually controlling an immersion speed of each of the ingots, in order to adjust the aluminum content in the preparation device to the required content, the plurality of ingots being immersed in the bath of the liquid metal mixture at a total fusion rate corresponding to a total calculated rate of zinc used.

* * * * *